US009351556B2

(12) United States Patent
Kim

(10) Patent No.: US 9,351,556 B2
(45) Date of Patent: May 31, 2016

(54) DROPPER-TYPE COSMETICS CONTAINER IN WHICH DIFFERENT TYPES OF CONTENTS CAN BE USED IN MIXED MANNER

(71) Applicant: YONWOO CO., LTD., Incheon (KR)

(72) Inventor: Yu-seob Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 39 days.

(21) Appl. No.: 14/390,878

(22) PCT Filed: Mar. 11, 2013

(86) PCT No.: PCT/KR2013/001922

§ 371 (c)(1),
(2) Date: Oct. 6, 2014

(87) PCT Pub. No.: WO2013/151244

PCT Pub. Date: Oct. 10, 2013

(65) Prior Publication Data

US 2015/0059923 A1 Mar. 5, 2015

(30) Foreign Application Priority Data

Apr. 6, 2012 (KR) ..... 10-2012-0035772

(51) Int. Cl.
*B01L 3/02* (2006.01)
*A45D 34/04* (2006.01)

(52) U.S. Cl.
CPC ..... *A45D 34/04* (2013.01); *A45D 2200/058* (2013.01); *B01L 3/0272* (2013.01)

(58) Field of Classification Search
CPC .... A45D 34/04; A45D 2200/058; B01L 3/00; B01L 3/0241; B01L 3/0272
USPC ..... 141/22, 112; 222/420; 604/82, 89, 295
See application file for complete search history.

(56) References Cited

U.S. PATENT DOCUMENTS 4,982,875 A * 1/1991 Pozzi ..... B65D 81/3222 222/129
5,217,433 A * 6/1993 Bunin ..... A61J 1/2093 206/221

(Continued)

FOREIGN PATENT DOCUMENTS

KR 20-0256383 12/2001
KR 20-0270335 4/2002

(Continued)

OTHER PUBLICATIONS

International Search Report issued in PCT/KR2013/001922 dated Jun. 13, 2013.

*Primary Examiner* — Timothy L Maust
(74) *Attorney, Agent, or Firm* — Marshall, Gerstein & Borun LLP

(57) ABSTRACT

The present invention relates to a dropper-typed cosmetic container for mixed use of two different kinds of contents. The dropper-typed cosmetic container for mixed use of two different kinds of contents can simply mix two different kinds of contents and can withdraw a proper amount of the mixed contents for use with a dropping part, by raising a content storage part while a rise and fall guide member engaged with an outer cap rotates together upon rotation of the outer cap and thus opening a lower end portion of the content storage part closed by a sealing member to move the contents stored in the content storage part to a container body.

8 Claims, 9 Drawing Sheets

(56) References Cited

U.S. PATENT DOCUMENTS

| | | | | |
|---|---|---|---|---|
| 8,444,610 | B2 * | 5/2013 | Grevin | A61M 35/00 222/420 |
| 9,221,048 | B2 * | 12/2015 | Duquet | A45D 34/04 |

FOREIGN PATENT DOCUMENTS

| | | | |
|---|---|---|---|
| KR | 20-0348004 | Y1 | 4/2004 |
| KR | 20-0407438 | Y1 | 1/2006 |
| KR | 2011-0016832 | A | 2/2011 |

* cited by examiner

DROPPER-TYPE COSMETICS CONTAINER IN WHICH DIFFERENT TYPES OF CONTENTS CAN BE USED IN MIXED MANNER

CROSS-REFERENCE TO RELATED APPLICATIONS

This U.S. non-provisional patent application claims the benefit of priority under 35 U.S.C. §119 of Korean Patent Application No. 10-2012-0035772, filed Apr. 6, 2012, the entire content of which is hereby incorporated by reference for all purposes.

BACKGROUND OF THE INVENTION

The present invention disclosed herein relates to a dropper-typed cosmetic container for mixed use of two different kinds of contents, and more particularly, to a dropper-typed cosmetic container for mixed use of two different kinds of contents, which can simply mix two different kinds of contents and can withdraw a proper amount of the mixed contents for use with a dropping part, by raising a content storage part while a rise and fall guide member engaged with an outer cap rotates together upon rotation of the outer cap and thus opening a lower end portion of the content storage part closed by a sealing member to move the contents stored in the content storage part to a container body.

Generally, most containers that are being distributed and used store one kind of content for use.

Recently, cases where a powder content is mixed with a liquid content or where different liquid contents are mixed with each other are increasing to improve the characteristics of the content. In this case, containers for storing two different kinds of contents need to be separately prepared. Accordingly, when two different kinds of contents are mixed with each other, there is an inconvenience in that two containers need to be dealt with.

Also, due to separate packaging and manufacturing of containers for two contents, resources may be wasted. Furthermore, contents are arbitrarily mixed by a user instead of being accurately mixed. In this case, when food and beverage are mixed, the taste may be changed or spoiled, causing a chemical change. Also, when chemicals and chemical products are mixed with each other, a physical change action such as an incomplete dissolution of a material effect may occur.

In order to overcome these limitations, various kinds of containers which store two different kinds of contents in one container and then mix the two different kinds of contents for use are being developed.

SUMMARY OF THE INVENTION

The present invention provides a dropper-typed cosmetic container for mixed use of two different kinds of contents, which can simply mix two different kinds of contents and can withdraw a proper amount of the mixed contents for use with a dropping part, by raising a content storage part while a rise and fall guide member engaged with an outer cap rotates together upon rotation of the outer cap and thus opening a lower end portion of the content storage part closed by a sealing member to move the contents stored in the content storage part to a container body.

Embodiments of the present invention provide dropper-typed cosmetic containers for mixed use of two different kinds of contents, comprising: a container body containing a first content; an inner cap having a cylindrical shape and coupled to the container body while covering an upper portion of the container body; an outer cap rotatably coupled to the inner cap over the container body while covering the inner cap and having a hollow part; a rise and fall guide member disposed inside the inner cap and engaging with an inner side of the outer cap so as to rotate together when the outer cap rotates, the rise and fall guide member having a pair of guide slits opposite to each other at both side surface thereof; a content storage part comprising a pair of guide protrusion each coupled to the pair of guide slits so as to rise and fall inside the rise and fall guide member according to the rotation of the rise and fall guide member and having a space for containing a second content, the content storage part having an lower end thereof opened; a sealing member closing the opened lower end of the content storage part; a rotation guide member disposed so as to engage with the inner cap between the inner cap and the rise and fall guide member and comprising a screw thread on an inner circumferential surface thereof to guide a movement of the guide protrusion; and a dropping part detachably coupled to the outer cap and withdrawing a fixed quantity of mixture of the first and second contents contained in the container body.

In some embodiments, the inner cap may include a seating step surrounding an inner circumferential surface such that the rise and fall guide member and the rotation guide member are seated thereon.

In other embodiments, the rotation guide member may include a plurality of rotation preventing protrusions formed on upper portions of an outer circumferential surface thereof and spaced from each other at a uniform interval so as to engage with the inner cap, and the inner cap may include a plurality of rotation preventing grooves formed at upper portions thereof such that the rotation preventing protrusions are inserted into portions meeting the rotation preventing protrusions.

In still other embodiments, the outer cap may include: a body coupled to the inner cap while covering the inner cap and comprises a rotation indication part on an outer circumferential surface thereof to indicate a rotation direction of the outer cap; a dropper coupling part upwardly extending from a central portion of an upper end of the body and screw-coupled to the dropping part; and a sealing member fixing part downwardly extending from the central portion of the upper end of the body and fixing the sealing member.

In even other embodiments, the rise and fall guide member may include a plurality of coupling protrusions formed on upper portions of an outer circumferential surface thereof and spaced from each other at a uniform interval so as to engage with the body of the outer cap, and the outer cap may have coupling grooves formed on an inner side of the body and coupled to the coupling protrusions at portions meeting the coupling protrusions.

In yet other embodiments, the dropping part may include: a grip part screw-coupled to the dropper coupling part; a dropper pipe downwardly extending from a center of the grip part, suctioning and discharging the contents, and having a cylindrical shape; and a rubber member coupled to an upper portion of the dropper pipe while covering the upper portion of the dropper pipe and suctioning and discharging the contents into/from the dropper pipe by a pressurization of a user In further embodiments, the sealing member may include: a sealing plate adhered closely to an inner circumferential surface of a lower end of the content storage part to close the lower end of the content storage part; and a coupling tube upwardly extending from a central portion of a top surface of the sealing plate to be coupled to the sealing member fixing part of the outer cap.

In still further embodiments, the content storage part may have a through hole at a central portion of an upper end thereof such that a dropper pipe is inserted into and withdrawn from the content storage part.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Figure 1:
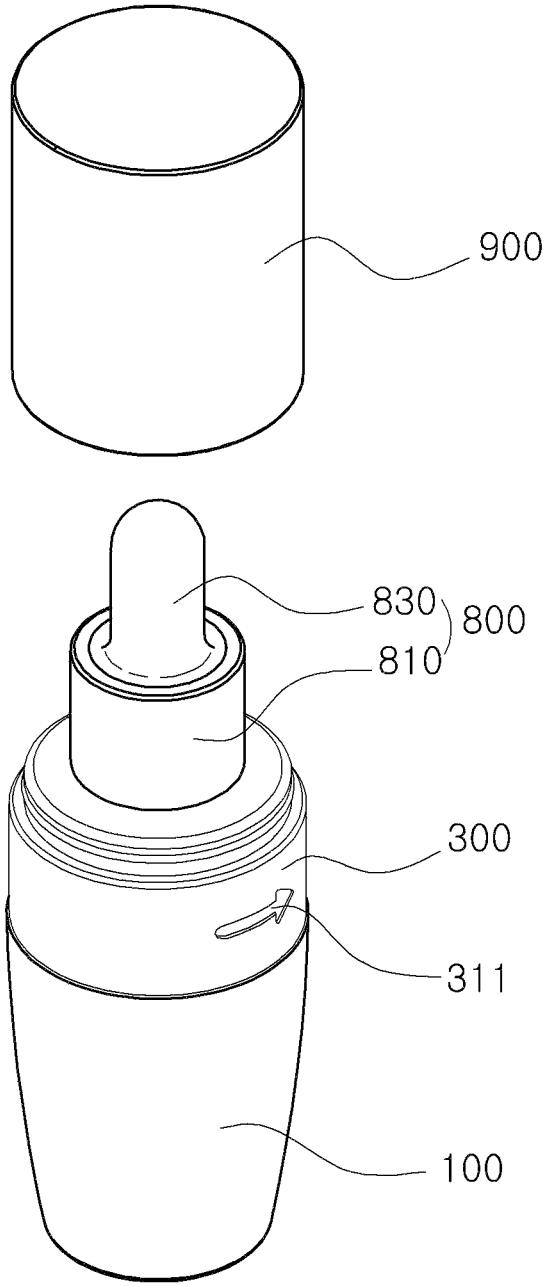
FIG. 1 is a perspective view illustrating a configuration of a dropper-typed cosmetic container for mixed use of two different kinds of contents according to an exemplary embodiment of the present invention.

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

Hereinafter, exemplary embodiments of the present invention will be described in detail with reference to the accompanying drawings. The same reference numerals provided in the drawings indicate the same members.

Figure 2:
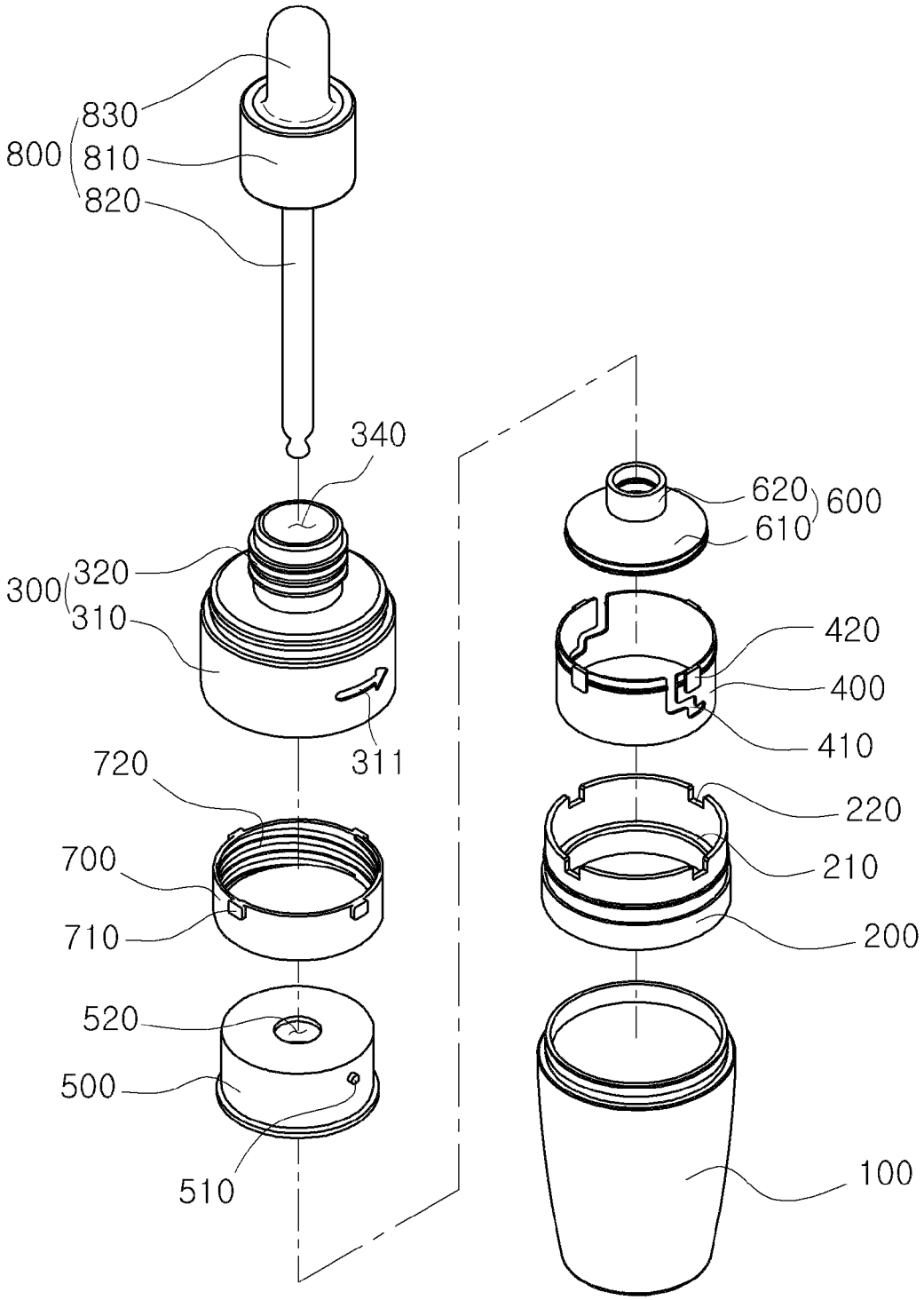
FIG. 2 is an exploded perspective view illustrating a configuration of a dropper-typed cosmetic container for mixed use of two different kinds of contents according to an exemplary embodiment of the present invention.
Figure 3:
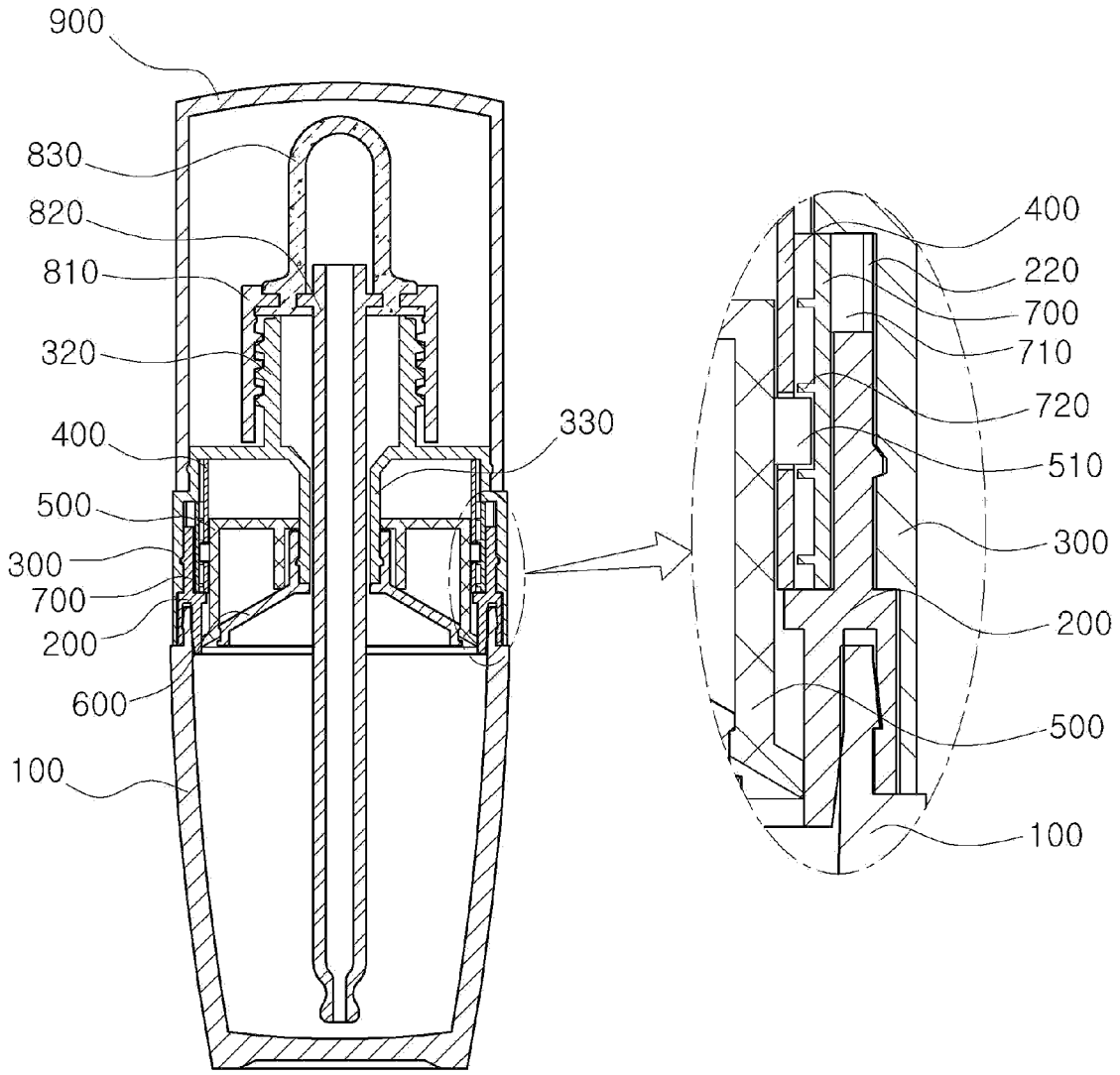
FIG. 3 is a cross-sectional view illustrating a configuration of a dropper-typed cosmetic container for mixed use of two different kinds of contents according to an exemplary embodiment of the present invention.
Figure 4:
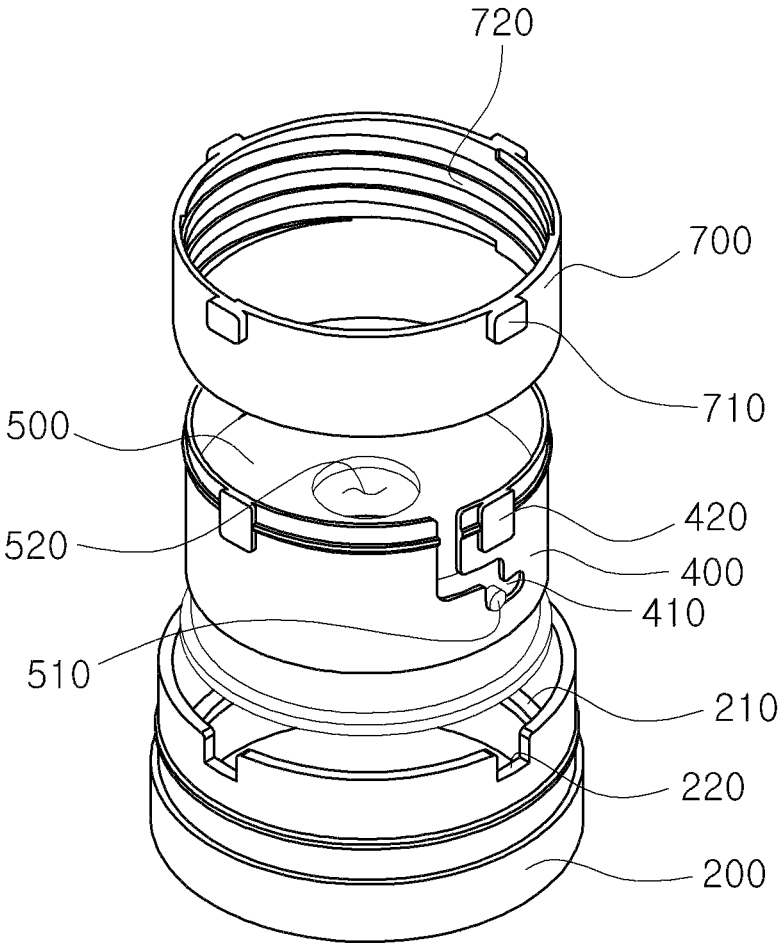
FIGS. 4 and 5 are views illustrating an assembled state of an inner cap, a rise and fall guide member, a content storage part, and a rotation guide member of a dropper-typed cosmetic container for mixed use of two different kinds of contents according to an exemplary embodiment of the present invention.
Figure 5:
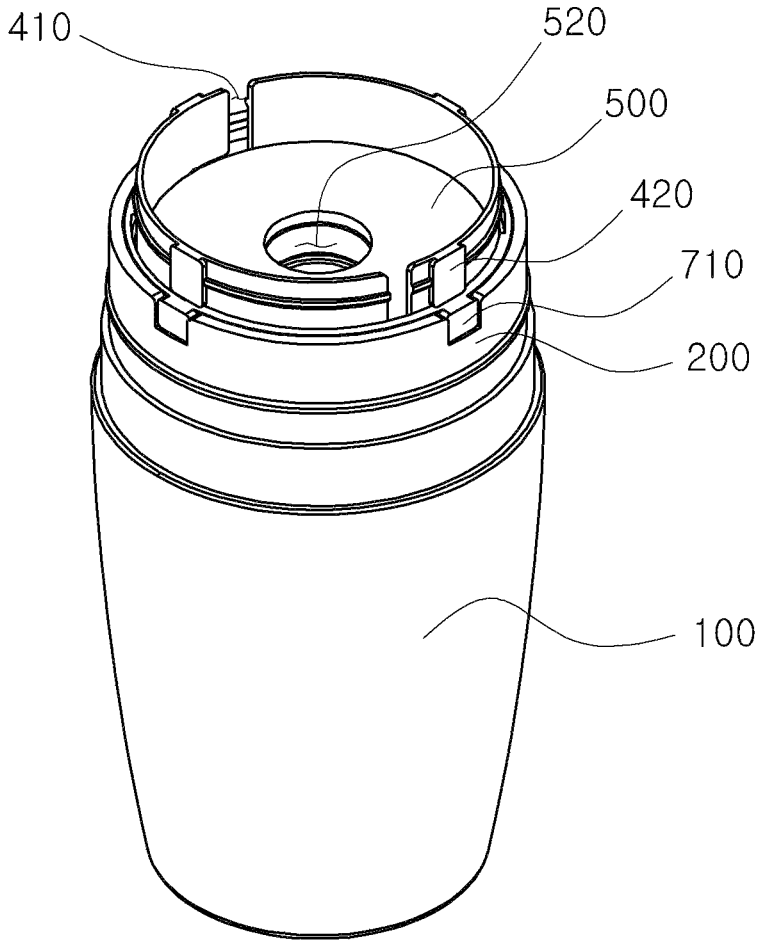
Figure 6:
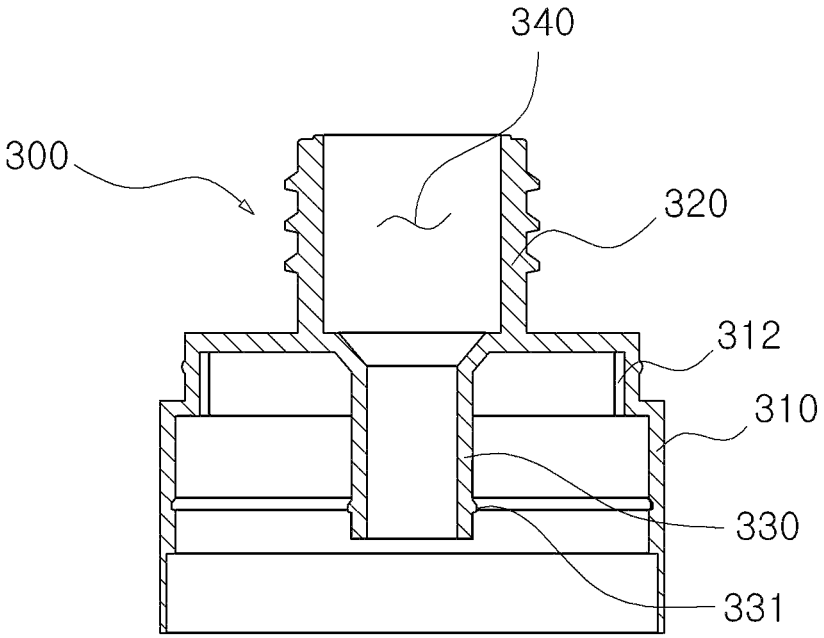
FIG. 6 is a view illustrating an outer cap of a dropper-typed cosmetic container for mixed use of two different kinds of contents according to an exemplary embodiment of the present invention.
Figure 6:
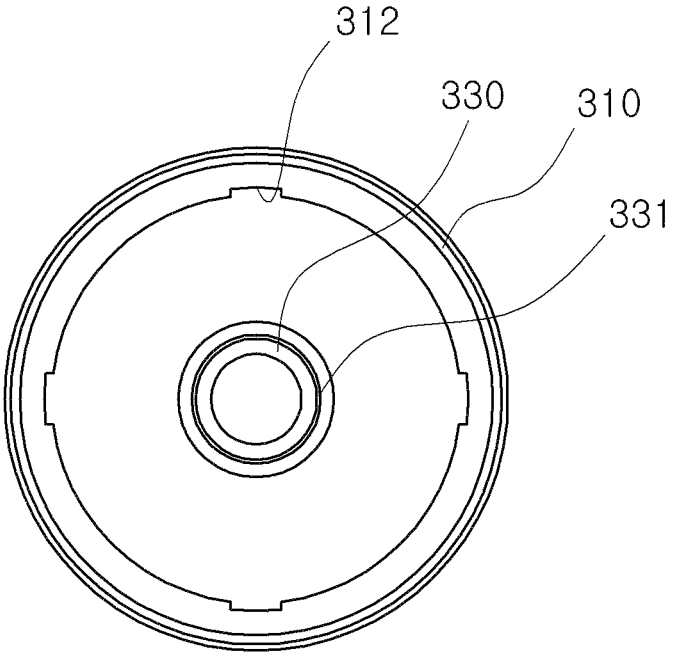

FIG. 1 is a perspective view illustrating a configuration of a dropper-typed cosmetic container for mixed use of two different kinds of contents according to an exemplary embodiment of the present invention. FIG. 2 is an exploded perspective view illustrating a configuration of a dropper-typed cosmetic container for mixed use of two different kinds of contents according to an exemplary embodiment of the present invention. FIG. 3 is a cross-sectional view illustrating a configuration of a dropper-typed cosmetic container for mixed use of two different kinds of contents according to an exemplary embodiment of the present invention FIGS. 4 and 5 are views illustrating an assembled state of an inner cap, a rise and fall guide member, a content storage part, and a rotation guide member of a dropper-typed cosmetic container for mixed use of two different kinds of contents according to an exemplary embodiment of the present invention. FIG. 6 is a view illustrating an outer cap of a dropper-typed cosmetic container for mixed use of two different kinds of contents according to an exemplary embodiment of the present invention.

Referring to FIGS. 1 to 6, a dropper-typed cosmetic container for mixed use of two different kinds of contents according to an exemplary embodiment of the present invention may include a container body 100, an inner cap 200, an outer cap 300, a rise and fall guide member 400, a content storage part 500, a sealing member 600, a rotation guide member 700, and a dropping part 800.

The container body 100 may contain a first content, and may include a coupling member formed at an upper portion thereof so as to enable coupling of the inner cap 200.

The inner cap 200 may be coupled to the container body 100 while covering the upper portion of the container body 100. The inner cap 200 may have a cylindrical shape with an upper end and a lower end opened. The inner cap 200 may include a seating step 210 formed at an inner side of the inner cap 200 and surrounding the inner circumferential surface such that the rise and fall guide member 400 and the rotation guide member 700 described later are seated the seating step 210.

In this embodiment, the inner cap 200 may have a rotation preventing groove 220 formed at an upper portion thereof to allow a rotation preventing protrusion 710 to be inserted into the rotation preventing groove 220 at a portion where the inner cap 200 meets the rotation preventing protrusion 710 of the rotation guide member 700. Through the coupling of the rotation preventing groove 200 and the rotation preventing protrusion 710, the inner cap 200 and the rotation guide member 700 may be configured to engage with each other, fixing the rotation guide member 700.

The outer cap 300 may cover the inner cap 200 at an upper portion of the container body 100, and may be rotatably coupled to the inner cap 300. The outer cap 300 may be coupled to the inner cap 200 while covering the inner cap 200, and may include a body 310 comprising a rotation indication part 311 formed on the outer circumferential surface of the body 310 so as to display the rotation direction, a dropper coupling part 320 upwardly extending from a central portion of the upper end of the body 310 and screw-coupled to the dropping part 800 described later, and a sealing member fixing part 330 downwardly extending from the central portion of the upper end of the body 310 and fixing the sealing member 600 described later.

In this embodiment, the body 310 may have coupling grooves 312 formed at inner sides thereof to allow coupling protrusions 420 to be coupled to the coupling grooves 312 at portions where the body 310 meets the coupling protrusions 420 of the rise and fall guide member 400. Through the coupling of the coupling groove 312 and the coupling protrusion 420, the outer cap 300 and the rise and fall guide member 400 may be configured to engage with each other, allowing the rise and fall guide member 400 to rotate together when the outer cap 300 rotates.

On the other hand, the outer cap 300 may have a hollow part 340 such that a dropper pipe 820 can be inserted into and withdrawn from the hollow part 340.

The rise and fall guide member 400 may be seated on the seating step 210 inside the inner cap 200, and may be formed to engage with the inner side of the outer cap 300 so as to rotate together when the outer cap 300 rotates. The rise and fall guide member may include a plurality of coupling protrusions 420 formed on an upper portion of the outer circumferential surface 310 thereof. The plurality of coupling protrusions 420 may be spaced from each other at a uniform interval, and may be coupled to the coupling grooves 312 of the body so as to engage with the body 310.

In this embodiment, the rise and fall guide member 400 may have a pair of guide slits 410 opposite to each other at both side surfaces thereof. When the rise and fall guide member 400 rotates according to the rotation of the outer cap 300, the guide slits 410 may guide the movement of a guide protrusion 510 of the content storage part 500 so as to the rising and falling of the content storage part 500.

The content storage part 500 may be configured to rise and fall inside the rise and fall guide member 400 according to the rotation of the rise and fall guide member 400. The content storage part 500 may include a pair of guide protrusions 510 formed at an upper portion of the outer circumferential surface thereof and coupled to the pair of the guide slits 410 so as to move along the guide slits 410.

The inside of the content storage part 500 may be spatially divided so as to contain a power or liquid type of a second content, and the lower end portion of the content storage part 500 may be opened. The lower end portion of the content storage part 500 may be closed by the sealing member 600 described later to block the second content from entering the container body 100. When the content storage part 500 rises, the opened lower end portion of the content storage part 500 may become spaced from the sealing member 600, allowing the second content to drop to the container body 100.

The content storage part 500 may have a through hole 520 formed at the central portion of the upper end of the content storage part 500 such that the dropper pipe 820 can be inserted into or withdrawn from the content storage part 500.

The sealing member 600 may close the opened lower end portion of the content storage part 500, and may include a sealing plate 610 adhered closely to the inner circumferential surface of the lower end of the content storage part 500 to close the lower end of the content storage part 500 and a coupling tube 620 upwardly extending from the central portion of the top surface of the sealing plate 610 and coupled to a sealing member fixing part 330 of the outer cap 300.

The rotation guide member 700 may be disposed to engage with the inner cap 200 between the inner cap 200 and the rise and fall guide member 400, and may include a plurality of rotation preventing protrusions 710 that are formed on upper portions of the outer circumferential surface and inserted into the rotation preventing grooves 220 so as to engage with the inner cap 200.

The rotation preventing protrusion 710 may be inserted into the rotation preventing groove 220 to fix the rotation guide member 700 to the inner cap 200. Thus, when the outer cap 300 and the rise and fall guide member 400 rotate, the rotation preventing protrusion 710 may not rotate, and may guide the movement of the guide protrusion 510 of the content storage part 500. The rotation guide member 700 may include a screw thread 720 formed on the inner circumferential surface and guiding the movement of the guide protrusion 510.

The rotation guide member 700 may guide the rising and falling of the content storage part 500, by guiding the movement of the guide protrusion 510 through the screw thread 720.

The dropping part 800 may be detachably coupled to the outer cap 300. The dropping part 800 may be screw-coupled to the dropper coupling part 320 while covering the dropper coupling part 320, and may include a grip part 810 gripped by a user, a dropper pipe 820 downwardly extending from the center of the grip part 810 and having a tubular shape suctioning and discharging contents, and a rubber member 830 disposed at the upper end of the grip part 810, coupled to the upper portion of the dropper pipe 820 while covering the upper portion of the dropper pipe 820, and suctioning and discharging contents into/from the dropper pipe 820 by a pressurization of a user.

When the second content stored in the content storage part 500 moves into the main body 100 and thus the first and second contents are mixed with each other, the dropping part 800 can allow a user to withdraw and use a fixed quantity of mixture of the first and second contents contained in the container body 100 through an manipulation of the rubber member 830.

Meanwhile, an over cap 900 may be disposed over the outer cap 300 to prevent the dropping part 800 from malfunctioning and protect the rubber member 830 of the dropping part 800. The over cap 900 may cover the dropping part 800.

Figure 7:
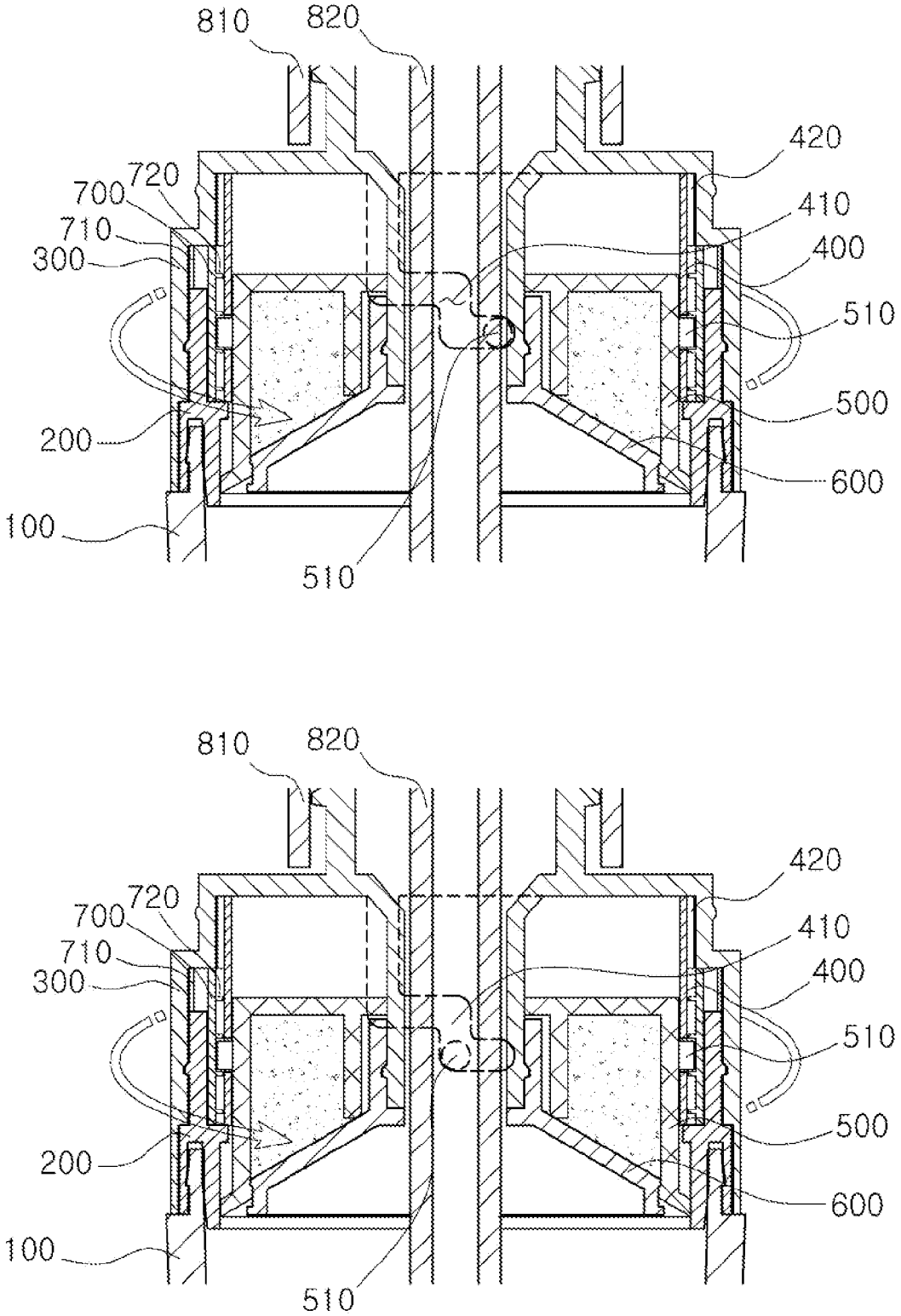
FIGS. 7 to 9 are views illustrating a method of using a dropper-typed cosmetic container for mixed use of two different kinds of contents according to an exemplary embodiment of the present invention.
Figure 8:
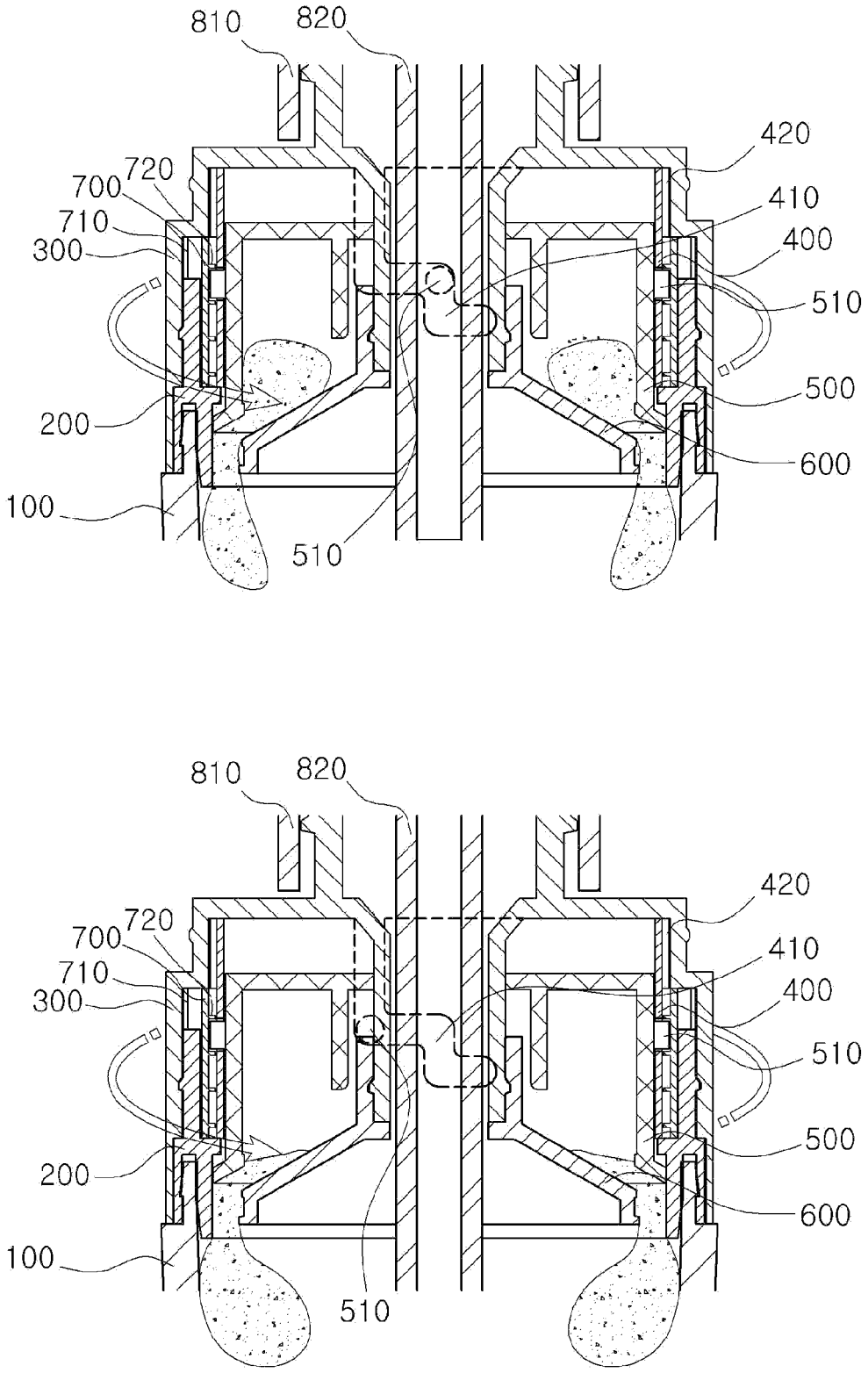
Figure 9:
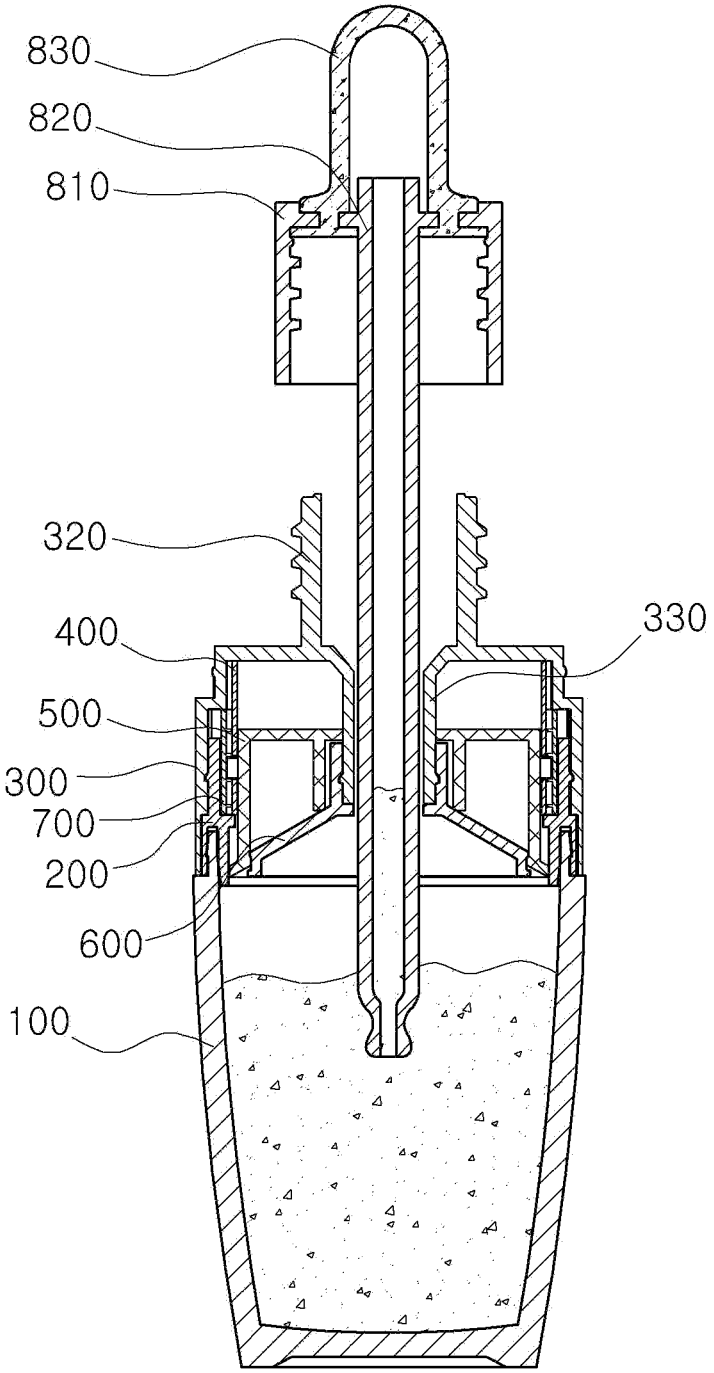

Hereinafter, an operation process of a dropper-typed cosmetic container for mixed use of two different kinds of contents according to an exemplary embodiment of the present invention will be described with reference to FIGS. 7 to 9. FIGS. 7 to 9 are views illustrating an operation state of a dropper-typed cosmetic container for mixed use of two different kinds of contents according to an exemplary embodiment of the present invention.

Referring to FIGS. 7 to 9, in the dropper-typed cosmetic container for mixed use of two different kinds of contents according to an exemplary embodiment of the present invention, when the guide protrusion 510 of the content storage part 500 is located at the lower end of the guide slit 410, the opened lower end of the content storage part 500 may be closed by the sealing member 600. When the outer cap 300 is rotated, the rise and fall guide member 400 engaged with the outer cap 300 may rotate together, and thus the guide protrusion 510 may move along the guide slit 410. In this case, the screw thread 720 of the rotation guide member 700 may guide the rising of the guide protrusion 510, and the content storage part 500 may rise according to the rising of the guide protrusion. Thus, the opened lower end of the content storage part 500 may become spaced from the sealing member 600, and thus the second content contained in the content storage part 500 may drop down into the container body 100, allowing the first content and the second content to be mixed with each other.

As described above, when the mixing of the first and second contents is completed, a user may manipulate the rubber member 830 of the dropping part 800 to suction the mixture of the first and second contents into the dropper piper 820, and then may detach the dropping part 800 from the outer cap 300. Thus, it is possible to withdraw and use a fixed quantity of the mixed contents.

As described above, the dropper-typed cosmetic container for mixed use of two different kinds of contents can simply mix two different kinds of contents and can withdraw a proper amount of the mixed contents for use with a dropping part, by raising a content storage part while a rise and fall guide member engaged with an outer cap rotates together upon rotation of the outer cap and thus opening a lower end portion of the content storage part closed by a sealing member to move the contents stored in the content storage part to a container body.

The above-disclosed subject matter is to be considered illustrative and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A dropper-type cosmetic container for mixed use of two different kinds of contents, comprising:

a container body containing a first content;

an inner cap having a cylindrical shape and coupled to the container body while covering an upper portion of the container body;

an outer cap rotatably coupled to the inner cap over the container body while covering the inner cap and having a hollow part;

a rise and fall guide member disposed inside the inner cap and engaging with an inner side of the outer cap so as to rotate together when the outer cap rotates, the rise and fall guide member having a pair of guide slits opposite to each other at both side surfaces thereof;

a content storage part comprising a pair of guide protrusions each coupled to the pair of guide slits so as to rise and fall inside the rise and fall guide member according to the rotation of the rise and fall guide member and having a space for containing a second content, the content storage part having a lower end thereof opened;

a sealing member closing the opened lower end of the content storage part;

a rotation guide member disposed so as to engage with the inner cap between the inner cap and the rise and fall guide member and comprising a screw thread on an inner circumferential surface thereof to guide a movement of the guide protrusion; and a dropping part detachably coupled to the outer cap and withdrawing a fixed quantity of mixture of the first and second contents contained in the container body.

2. The dropper-typed cosmetic container of claim 1, wherein the inner cap comprises a seating step surrounding an inner circumferential surface such that the rise and fall guide member and the rotation guide member are seated thereon.

3. The dropper-typed cosmetic container of claim 1, wherein the rotation guide member comprises a plurality of rotation preventing protrusions formed on upper portions of an outer circumferential surface thereof and spaced from each other at a uniform interval so as to engage with the inner cap, and the inner cap comprises a plurality of rotation preventing grooves formed at upper portions thereof such that the rotation preventing protrusions are inserted into portions meeting the rotation preventing protrusions.

4. The dropper-type cosmetic container of claim 1, wherein the outer cap comprises:

a body coupled to the inner cap while covering the inner cap and comprises a rotation indication part on an outer circumferential surface thereof to indicate a rotation direction of the outer cap;

a dropper coupling part upwardly extending from a central portion of an upper end of the body and screw-coupled to the dropping part; and a sealing member fixing part downwardly extending from the central portion of the upper end of the body and fixing the sealing member.

5. The dropper-type cosmetic container of claim 4, wherein the rise and fall guide member comprises a plurality of coupling protrusions formed on upper portions of an outer circumferential surface thereof and spaced from each other at a uniform interval so as to engage with the body of the outer cap, and the outer cap has coupling grooves formed on an inner side of the body and coupled to the coupling protrusions at portions meeting the coupling protrusions.

6. The dropper-type cosmetic container of claim 4, wherein the dropping part comprises:

a grip part screw-coupled to the dropper coupling part;

a dropper pipe downwardly extending from a center of the grip part, suctioning and discharging the contents, and having a cylindrical shape; and a rubber member coupled to an upper portion of the dropper pipe while covering the upper portion of the dropper pipe and suctioning and discharging the contents into/from the dropper pipe by a pressurization of a user.

7. The dropper-type cosmetic container of claim 4, wherein the sealing member comprises:

a sealing plate adhered closely to an inner circumferential surface of a lower end of the content storage part to close the lower end of the content storage part; and a coupling tube upwardly extending from a central portion of a top surface of the sealing plate to be coupled to the sealing member fixing part of the outer cap.

8. The dropper-type cosmetic container of claim 1, wherein the content storage part has a through hole at a central portion of an upper end thereof such that a dropper pipe is inserted into and withdrawn from the content storage part.

* * * * *